US007761949B1

(12) United States Patent
Hughes, IV

(10) Patent No.: US 7,761,949 B1
(45) Date of Patent: Jul. 27, 2010

(54) BATHTUB BRUSH WITH DEFINED PIVOT

(76) Inventor: Taylor Hughes, IV, Apt. C, 1821 Lake Knoll Dr., Cincinnati, OH (US) 45231

( * ) Notice: Subject to any disclaimer, the term of this patent is extended or adjusted under 35 U.S.C. 154(b) by 0 days.

(21) Appl. No.: 12/460,012

(22) Filed: Jul. 10, 2009

Related U.S. Application Data

(63) Continuation-in-part of application No. 11/728,408, filed on Mar. 26, 2007, now abandoned.

(60) Provisional application No. 60/785,890, filed on Mar. 27, 2006.

(51) Int. Cl.
*B25G 3/38* (2006.01)

(52) U.S. Cl. ..... 15/172; 15/144.1; 16/900; 403/113; 403/117

(58) Field of Classification Search ..... 15/144.1, 15/172; 16/900; 403/113, 117
See application file for complete search history.

(56) References Cited

U.S. PATENT DOCUMENTS 109,946 A * 12/1870 Rockwell et al. ..... 15/117
3,704,479 A * 12/1972 Whitaker ..... 15/172
4,455,705 A * 6/1984 Graham ..... 15/121
5,319,824 A * 6/1994 Cook, III ..... 15/160
6,279,189 B1 * 8/2001 Cassar ..... 15/144.1
6,760,949 B2 * 7/2004 Kaminstein et al. ..... 15/164

* cited by examiner

*Primary Examiner*—Mark Spisich
(74) *Attorney, Agent, or Firm*—Neal O. Willmann

(57) ABSTRACT

The brush and handle assembly described herein are specifically designed to scrub and clean all interior surfaces of a bathtub. The elongated handle and brush-head are designed and constructed to permit pivoting the brush-head relative to the handle, but the pivoting movement is confined to a range of 0° to less than 180°. In the preferred embodiment of the disclosed brush, the range of pivoting movement is about 135°. Limiting the pivotal movement of the brush-head relative to the handle enables the user of the disclosed bathtub brush to scrub and clean, easily and efficiently, all interior surfaces, including the interior far-side, the interior near-side, the interior ends and the bottom surface of the typical bathtub without uncomfortable body contortions.

5 Claims, 2 Drawing Sheets

BATHTUB BRUSH WITH DEFINED PIVOT

CROSS-REFERENCE TO RELATED APPLICATION

This application is a continuation-in-part of application Ser. No. 11/728,408 filed Mar. 26, 2007, abandoned, the entire specification of which is hereby incorporated in this application by reference, said first filed application claiming the benefit of the filing date of U.S. Provisional Application No. 60/785,890 filed Mar. 27, 2006.

BACKGROUND OF THE INVENTION

The disclosed invention relates generally to scrubbing brushes. More specifically, it relates to a specially designed bathtub brush. A bathtub brush made according to the features and refinements disclosed herein facilitates the scrubbing and cleaning of the interior surfaces of a typical bathtub, or even a shower. In particular, because of the defined articulation or range of pivoting movement between the elongated handle and the brush-head, the disclosed brush offers and provides a more efficient angle for the handle, relative to the brush-head, for scrubbing the interior surfaces of a typical bathtub, and especially the interior far-side surface, the interior bottom, and the interior end surfaces while not neglecting the interior near-side wall.

DESCRIPTION OF THE PRIOR ART

U.S. Pat. No. 5,528,792, which issued to Nazemi on Jun. 25, 1996, describes a shower brush, for scrubbing the human torso while taking a shower, having a handle on one end and bristles on the other and an axial pivot point between two 90° bends in the shank of the brush between the handle and the bristles. The medially placed pivot point thus permits S-shaped and U-shaped configurations of the brush by simply rotating the handle shank portion relative to the bristle shank portion. The U-shaped configuration of the brush is intended to facilitate scrubbing one's back and the S-shaped configuration is intended to facilitate scrubbing one's lower extremities.

U.S. Pat. No. 6,216,307, which issued to Kaleta et al. on Apr. 17, 2001, describes a hand-held cleaning device having a base frame supporting two planar surfaces with a sponge element on one surface and a scrubbing element on the other (opposite) surface. The base frame is pivotally attached to the bottom of an elongated handle such that it pivots to provide either sponge or scrubbing surfaces relative to item being cleaned, typically, a floor.

U.S. Pat. No. 6,709,529, which issued to Mekwinski on Mar. 23, 2004, describes a roof brush having a vertical arm pivotally attached to a horizontal arm and a cleaning head disposed on the vertical arm. One embodiment of the roof cleaning brush provides a bolt and butterfly nut to pivotally attach the horizontal to the vertical arms.

SUMMARY OF THE INVENTION

Specifically disclosed herein is a bathtub brush having an elongated handle pivotally attached to a brush-head having a bristled component and a platform component supporting a pivoting means.

More specifically, the disclosed bathtub brush comprises a brush-head consisting of a platform supporting an array of bristles and a pivoting means. Attached to the pivoting means are an elongated handle and a pivot limiting element, which limits the range of pivoting movement between the brush-head and the handle to <180°.

Structurally, the preferred scrub brush comprises a brush-head consisting of a platform supporting an array of bristles and an arch-shaped pivoting means having paired lateral surfaces and a hole medially positioned through said lateral surfaces said hole defining a pivot axis for the insertion of a pivot pin. The preferred brush also features an elongated handle having an attachment means including a pivot fork with paired pivot holes, said handle attached to said pivoting means by said pivot pin axially inserted through said paired pivot holes in said pivot fork and through said medially positioned hole in said pivoting means, said handle thereby enabled to rotate around said pivot pin in a radial movement as defined by said arch-shaped pivoting means. The pivot limiting element is attached to the lateral surfaces of the pivoting means to limit the range of the radial pivoting movement between the brush-head and the handle.

The disclosed scrub brush is specifically designed to facilitate the cleaning of bathtubs; and therefore, it is preferred that the range of movement between the brush-head and the handle be less than 180°, thereby enabling the brush-head to be positioned within the range of 0° to <180° to facilitate the scrubbing of all the interior walls of a bathtub. It is of particular value and interest that the brush-head be positioned and stopped at an angle relative to the handle approximately midway between 90° and 180° to facilitate scrubbing the inside far-wall and the two inside end-walls and the bottom surface of the bathtub.

DETAILED DESCRIPTION OF THE PREFERRED EMBODIMENT

Figure 1:
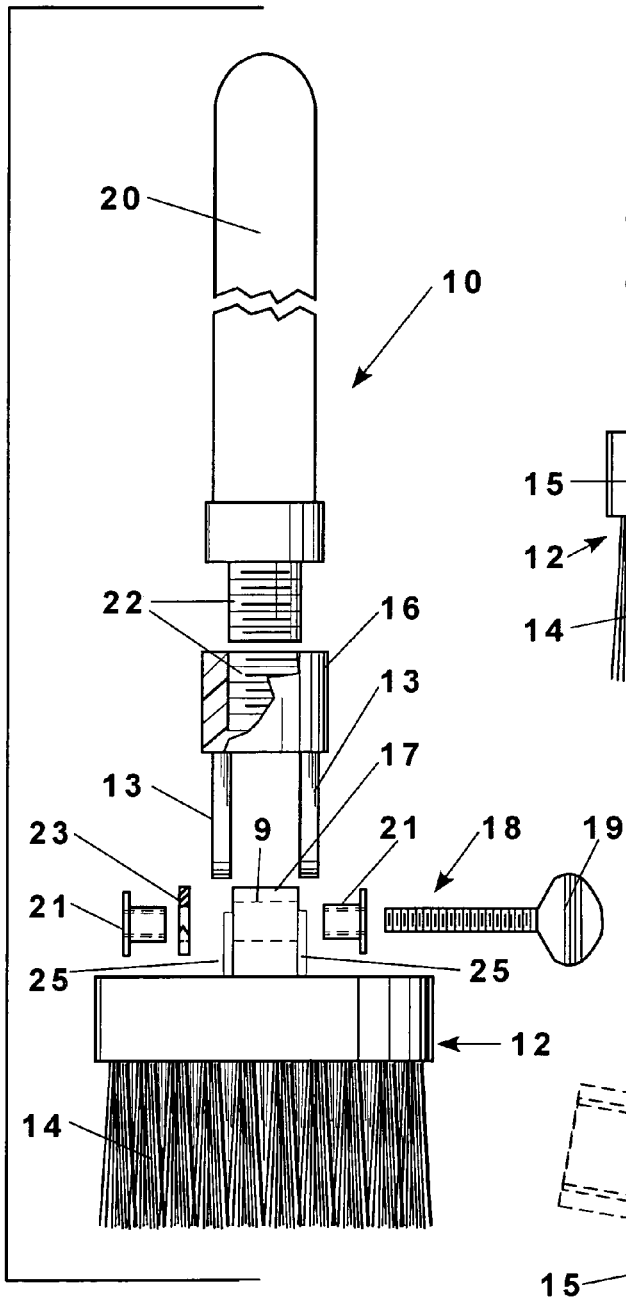
FIG. 1 is an exploded side view of the elements of the disclosed brush.

The inventive feature of the disclosed bathtub brush and the method of deploying it to scrub bathtubs become readily apparent by frequent reference to the drawing. In FIG. 1 the essential elements and all components of the disclosed brush are shown in a disassembled view with all of the parts arrayed for easy identification. The elements of the brush 10 include the brush-head 12, which consists of a platform 15 serving to support an array of bristles 14 and a pivoting means 17. Clearly, it is the bristles that come in contact with the surface to be scrubbed and cleaned, and in this instance, the surface to be scrubbed and cleaned is the interior surface of a bathtub. The bristles 14 are secured to the platform 15 in any manner suitable to hold the bristles securely.

The pivoting means 17 is an arch-shaped structure, supported by the brush-head platform 15 and preferably positioned on top of the platform, on the side opposite the bristles. The pivoting means is preferably permanently attached to the platform and, in most instances, will be molded to be an integral part of the platform. Structurally, it requires an opening or transverse hole 9 to define a pivot axis for the insertion of attachment hardware 18, which also functions as a pivot pin, and a stop or pivot limiting means 25. It is the stop or pivot limiting element or means 25 that is the inventive feature of the brush 10. The hole 9 provides and provides the pivot axis or point around which the brush-head will pivot relative to the elongated handle 20 attached to the brush-head 12 at the pivoting means. The hole 9 also enables the attachment hardware 18 to secure the elongated handle to the brush-head 12 when the openings 8 in the pivot fork 13 are aligned with the hole 9 in the pivoting means. The pivot fork is, of course, attached to the distal end of the elongated handle 20 via an attachment means 16. As currently depicted, the elongated handle is threadably 22 attached to the attachment means 16. At the current state of development, the attachment hardware consists of a threaded thumbscrew 19, a pair of threaded bushings 21 and a resilient washer 23. Clearly, refinements in the method and means of attaching the elongated handle 20 to the pivoting means 17 on the brush-head 12 will be developed and evolve as acceptance of the brush 10 becomes widespread. But, again, the means of mechanical attachment are relatively inconsequential when compared to the pivoting means 17 and its associated stop 25.

Figure 2:
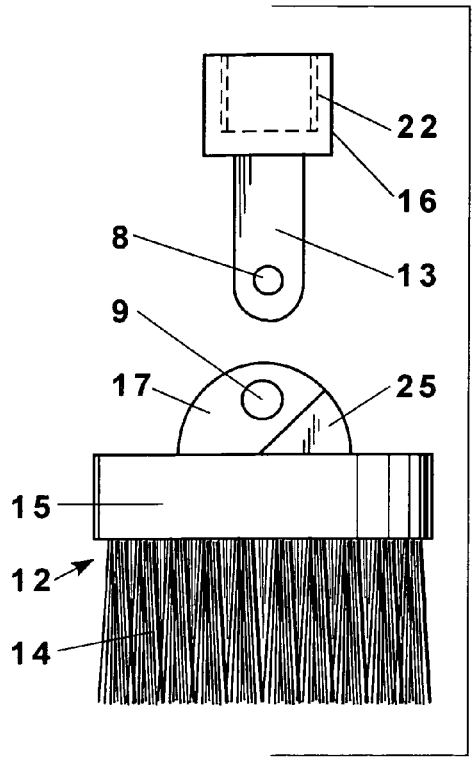
FIG. 2 is an elevated side view of the disassembled brush illustrating the means of pivotal attachment between the handle and the brush-head.

FIG. 2 offers an isolated, disassembled view of the brush-head 12, the pivoting means 17, the pivoting limiting means or stop 25 and the hole 9 to be aligned with the holes 8 in the pivot fork 13 of the threaded 22 attachment means 16. The threaded attachment means 16 is, of course, threaded to mate with the threads on the 22 elongated handle.

Figure 3:
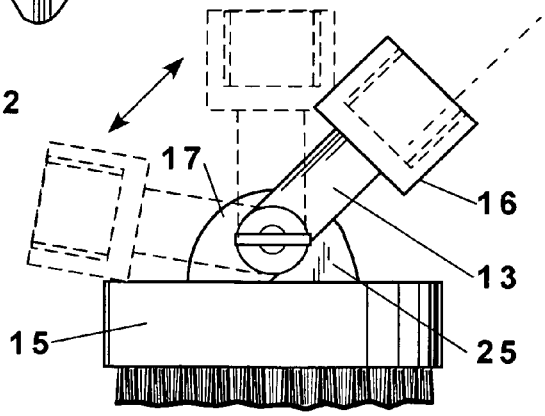
FIG. 3 is an isolated side view of the brush-head and handle attachment means illustrating the range of pivotal motion of the handle relative to the brush-head.

FIG. 3 provides an isolated view of the attachment means 16 secured to the pivoting means 17 and the range of motion afforded by the pivoting means and limited by the stop 25. Of particular importance is the role of the pivot limiting means 25, which limits the pivoting motion of the brush-head (or the elongated handle, depending on perspective) relative to the handle. Without the pivoting limiting means or stop 25, the brush-head would be free to rotate about the handle within a range of 180°. With the stop 25, the range of pivoting motion for the brush-head relative to the handle is confined to an obtuse angularity greater than 90° and <180°. Currently, suitable results have been demonstrated by limiting the range of obtuse angular movement to about 135°.

Figure 4:
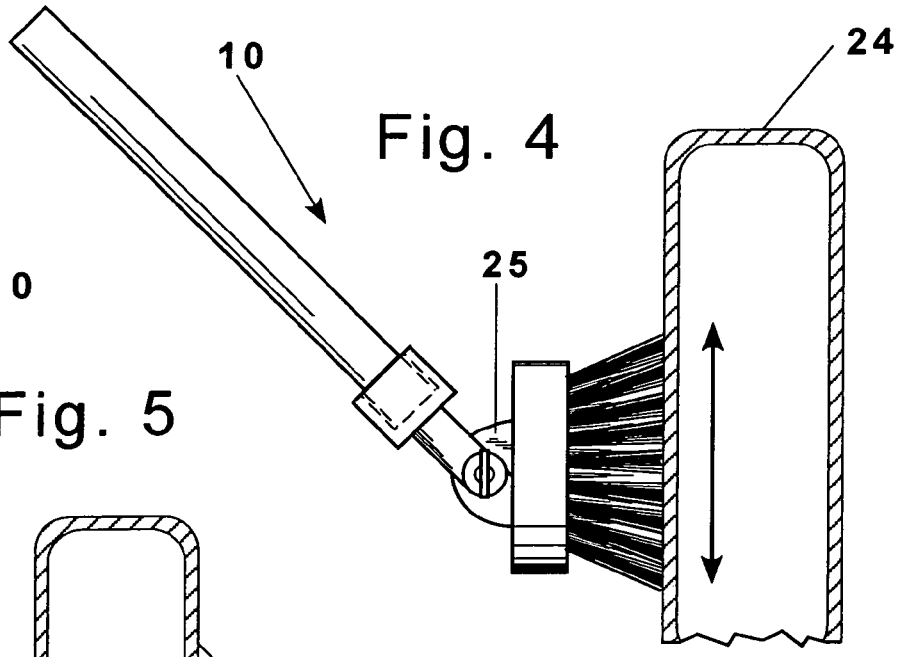
FIG. 4 illustrates the pivotal movement of the brush-head against the stop at an angle preferred for scrubbing the inside far-wall of a bathtub.
Figure 5:
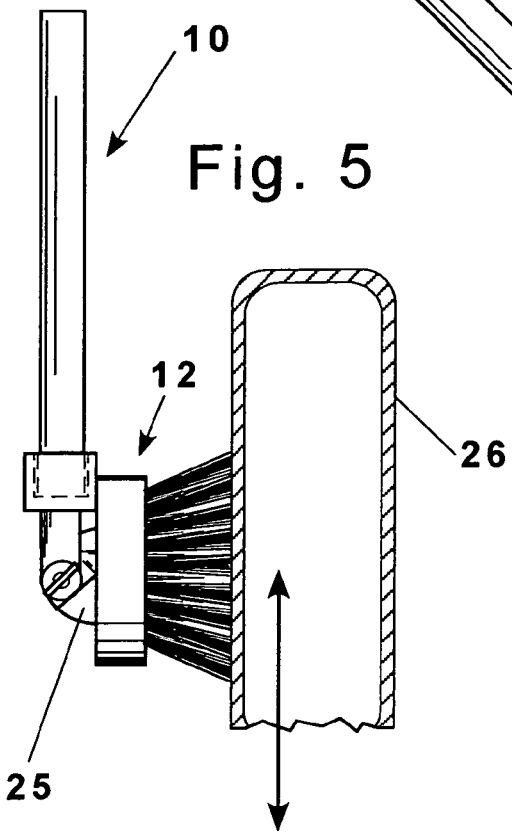
FIG. 5 illustrates the pivotal movement of the brush-head aligned with the handle at 0°, the preferred angle for scrubbing the inside near-wall of a bathtub.
Figure 6:
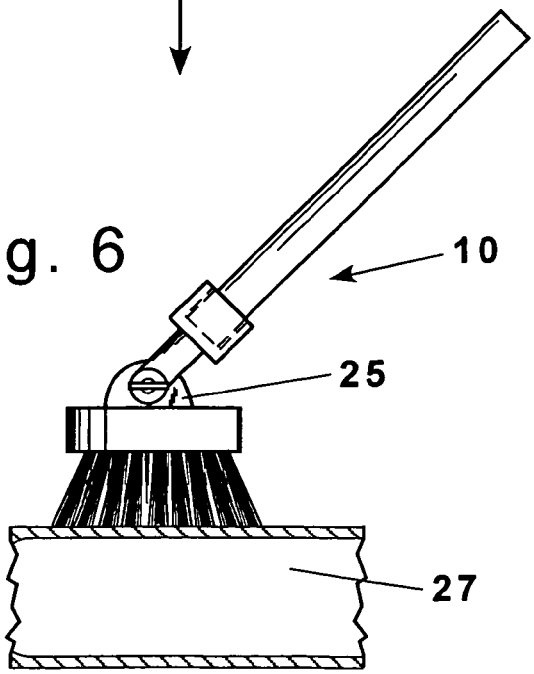
FIG. 6 illustrates the pivotal movement of the brush-head against the stop at an angle preferred for scrubbing the floor of a bathtub.
Figure 7:
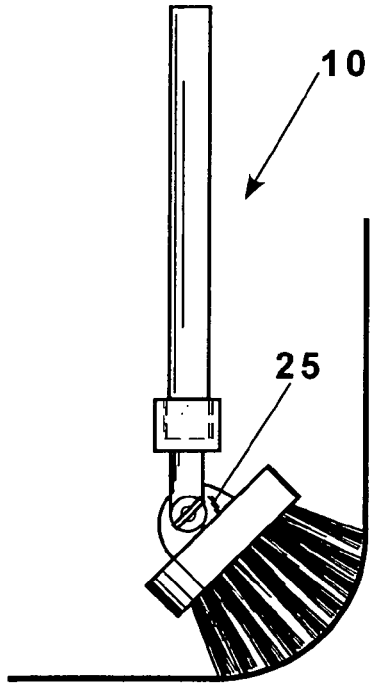
FIG. 7 illustrates the pivotal movement of the brush-head against the stop at an angle preferred for scrubbing the corners of a bathtub.

The importance and desirability of having the range of pivotal motion limited by the stop 25 is illustrated in FIGS. 4, 5, 6 and 7. In FIG. 4 the brush 10 is depicted in the orientation for effectively scrubbing the interior far-wall 24 of a bathtub. The stop 25 orients the brush-head so that the bristles fully engage the inner surface of the interior far-wall and thereby allow all of the scrubbing surface of the bristles to engage the interior wall of the tub while the elongated handle of the brush can be held at an angle comfortable to the janitor manipulating the brush from outside the tub. Compare the depiction of FIG. 4 with the depiction of FIG. 5 where the brush-head 12 is in the appropriate orientation for scrubbing the interior surface of the near-wall. In this mode, the janitor simply stands outside the tub, over the near-wall, and manipulates the brush in a simple vertical motion. Note that there is no angle between the brush-head and the handle because the stop 25 has no bearing on the orientation of the brush-head. In this orientation, the brush-head is deemed to be at an angle of 0° with the handle. FIGS. 6 and 7 further illustrate the importance and advantage of using a brush with a brush-head having a defined range of pivotal movement relative to the handle to scrub the other problematic interior surfaces of the typical bathtub.

While the foregoing is a detailed and complete description of the preferred embodiments of the disclosed bathtub scrub brush, it should be apparent that numerous variations and modifications can be made and employed to implement the all important purpose of the disclosed brush without departing from the spirit of the invention, which is fairly defined by the appended claims.

The invention claimed is:

1. A scrubbing brush which comprises: a brush-head consisting of a platform supporting an array of bristles and an arch-shaped pivoting means having paired lateral surfaces and a hole medially positioned through said lateral surfaces said hole defining a pivot axis for the insertion of a pivot pin;

an elongated handle having an attachment means including a pivot fork with paired pivot holes, said handle attached to said pivoting means by said pivot pin axially inserted through said paired pivot holes in said pivot fork and through said medially positioned hole in said pivoting means, said handle thereby enabled to rotate around said pivot pin in a radial movement as defined by said arch-shaped pivoting means; and, a pivot limiting element attached to the lateral surfaces of said pivoting means to limit the range of radial pivoting movement between said brush-head and said handle.

2. The scrubbing brush according to claim 1 wherein the pivot limiting element limits the pivoting movement to less than 180°.

3. The scrubbing brush according to claim 1 wherein the elongated handle is threadably attached to said attachment means.

4. The scrubbing brush according to claim 1 wherein the pivot limiting element limits the pivoting movement to less than 150°.

5. The scrubbing brush according to claim 1 wherein the pivot limiting element limits the pivoting movement to about 135°.

* * * * *